United States Patent [19]

Phillips

[11] 4,296,510

[45] Oct. 27, 1981

[54] ANTI-SURGE FLOTATION MATTRESS

[76] Inventor: Raymond M. Phillips, 5500 W. 83rd St., Los Angeles, Calif. 90045

[21] Appl. No.: 72,126

[22] Filed: Sep. 4, 1979

[51] Int. Cl.[3] ..... A47C 27/08

[52] U.S. Cl. ..... 5/450; 5/451

[58] Field of Search ..... 5/451, 452, 457, 458, 5/449, 448; 137/574, 576; 297/DIG. 3

[56] References Cited

U.S. PATENT DOCUMENTS

| | | | |
|---|---|---|---|
| 4,141,770 | 2/1979 | Mollura | 5/451 |
| 4,152,796 | 5/1979 | Fogel | 5/457 |
| 4,168,555 | 9/1979 | Benjamin | 5/452 |
| 4,192,031 | 3/1980 | Fogel | 5/451 |
| 4,204,289 | 5/1980 | Fogel | 5/451 |
| 4,247,962 | 2/1981 | Hall | 5/451 |

*Primary Examiner*—Ramon S. Britts
*Assistant Examiner*—Alexander Grosz
*Attorney, Agent, or Firm*—Georges A. Maxwell

[57] ABSTRACT

A water bed flotation mattress comprising a bladder of flexible sheet plastic with vertically spaced horizontal top and bottom walls and vertical side and end walls and slackily filled with a fluid medium; said mattress including a thin, flat, flexible, horizontal intermediate wall normally in spaced parallel relationship between the top and bottom walls and a plurality of laterally spaced parallel thin and flexible partitions fixed to and extending between the intermediate and bottom walls and cooperating therewith to define elongate open ended fluid conducting tunnels and float structure about the plane of the intermediate wall to normally buoy up the intermediate wall and partitions within the mattress.

8 Claims, 8 Drawing Figures

ANTI-SURGE FLOTATION MATTRESS

This invention relates to waterbeds and is particularly concerned with an improved waterbed flotation mattress.

BACKGROUND OF THE INVENTION

Ordinary waterbeds of the type or class here concerned with comprise upwardly opening rectangular frame structures including flat horizontal mattress supporting platforms and flat, vertically upwardly projecting side and end boards with straight horizontal top edges about their perimeters; and water or flotation mattresses arranged within the frame structures in supported engagement atop the platforms and in retained engagement with the side and end boards.

Waterbed frame structures are commonly fabricated of wood and the like and often lined or padded with various soft materials such as styrofoam. In more recent times, such frame structures have been formed entirely of molded styrofoam sections.

Ordinary waterbed flotation mattresses are generally simple bladder like units of flexible plastic sheeting such as polyvinylchloride, and are filled with any desired and suitable fluid medium, such as water. Fluid medium or water filled flotation mattresses are constructed or formed to substantially conform with the interior space defined by the bed frame structures with which they are to be related and have or define normally flat horizontal body supporting top walls, flat horizontal bottom walls and normally vertically side and end walls. The bottom, side and end walls normally establish flat supported engagement with the platforms and with the side and end boards of their related bed frame structures. The body supporting top walls of such mattresses normally occur on a horizontal plane substantially coincidental with the planes of the frame structures on which the upper edges of the side end boards occur.

In practice, the vertical extent or depth of flotation mattresses, that is, the normal vertical space or distance between the top and bottom walls and the depth of the water or fluid medium therein is, for example, about 8" and is such that when parts and/or portions of the bodies of persons (of maximum anticipated weight) are engaged on and supported by the top walls of the mattresses, the top walls are urged or depressed downwardly thereby, displacing volumes of water within the mattress to such an extent that the bodies are buoyantly supported. The depth or vertical extent of the mattresses is such that the top walls will not, under normal circumstances engage and come to rest on or "bottom out" on the bottom walls of the mattresses and against the platforms of the bed frames, when subjected to normal use.

Flotation mattresses of the character referred to above are fabricated of panels and/or pieces of plastic sheet stock cut, folded and welded together in accordance with predetermined patterns and procedures. The patterns, procedures and fabricating techniques employed by different manufacturers of such mattresses varies widely, but in most instances, the resulting mattresses are essentially alike as regards their basic configuration and definable top, bottom, side and end walls, noted in the preceding.

A major objection or shortcoming found in waterbeds resides in the tendency of the fluid medium or water within the mattresses to surge and create continuing diminishing motion, in the nature of waves, when bodies are initially engaged on the mattresses and when the bodies on the mattresses move or shift position. The noted surge and residual wave action is oftentimes quite disturbing to persons on the mattresses and is such that some persons experience motion sickness when surging and wave action is generated by the movment of their bodies or the bodies of others on the mattresses.

While the above noted surging and wave action generated in flotation mattresses is soothing and restful to some people, others cannot tolerate it. Accordingly, the attributes of waterbeds are the subject of some controversy which has caused adverse effects on the sale and use of such beds.

It has been determined that if the surging and wave action in waterbeds could be effectively eliminated or reduced to an extent that it was no longer a problem, many persons who cannnot or will not tolerate the surging and/or residual wave action experienced in the use of present day waterbeds, would find no objecton to and would purchase and adopt the use of such beds to gain the principal advantages afforded thereby; that is, the uniform, conforming and fluid body support such beds provide.

The prior art has long sought to eliminate or reduce the surging and wave action in flotation mattresses by the placement of baffles within the mattresses to slow or dampen the movement of water therein. Such efforts have met with limited or questionable success and have often been so costly to put into practice that they are economically impractical.

Other attempts or means by the prior art to eliminate and/or reduce the surge and wave action in waterbeds has been directed to the establishment of mattress structures which are combinations of and constitute a compromise between flotation mattresses and conventional resilient foam plastic mattresses. In such structures, resilient foam plastic mattress pads are arranged within the bottom portions of common flotation mattresses or are arranged beneath special flotation mattresses of limited or less than normal vertical extent whereby the depth and resulting volume of water or fluid medium, above the foam mattresses, is reduced to an extent that surging and residual wave action is notably reduced.

This reduction in surging and residual wave action is due to the reduction in the volume of free to flow and move water to a volume which will not support large or heavy surging and will not sustain notable residual wave action.

Some combination mattress structures of the character referred to above effectively reduce surging and wave action to acceptable levels but in doing so, reduce the depth and volume of water or fluid medium so that full buoyant support of the bodies of persons engaged on the mattresses is not assured and is oftentimes unattainable. Such combination of mattress structures are generally considered a compromise between true flotation mattresses and foam plastic mattresses and are condsidered to be of questionable value or effectiveness.

OBJECTS AND FEATURES OF THE INVENTION

An object of the present invention is to provide a novel flotation mattress structure including novel means to substantially reduce surging and wave action of the fluid medium therein to negligible levels.

It is an object and feature of the invention to provide a mattress of the general character referred to having flexible top, bottom, side and end walls and a horizontal intermediate wall in limited spaced parallel relationship with and below the top wall, a plurality of laterally spaced, parallel, flexible partitions between the intermediate and bottom walls, with ends spaced from the end walls and defining a plurality of laterally spaced longitudinally extending fluid medium conducting tunnels within the lower portion of the mattress and fluid medium transfer means communicating with the ends of the tunnels, at each end of the structure, whereby fluid medium displaced from the tunnels upon depressing portions of the top and intermediate walls and resulting collapsing of adjacent portions of related tunnels, is caused to flow through the transfer means and thence into other tunnels whereby the direction of movement of the fluid medium within the mattress, below the intermediate wall, is controlled and slowed to materially reduce surging and subsequent wave action in the fluid medium within the mattress.

Another object of my invention is to provide a novel mattress structure of the general character referred to above wherein the fluid transfer means slows the flow of the liquid medium within the mattress outward of the tunnels and allows for substatial free flow of said liquid medium into the tunnels so that the forced displacement of the medium from tunnels at the depressed or collapsed portions of the mattress is slowed and the acceptance of the displaced medium into the tunnels throughout the other portions of the mattress is substantially unrestricted; and so that the flow of previously displaced liquid from the tunnels at said other portions of the mattress back to the tunnels at the depressed portions of the mattress is slowed whereby surging of the fluid medium and subsequent wave action within the mattress is slowed to an extent that it creates no appreciable adverse effect.

The foregoing and other objects and features of the present invention will be fully understood from the following detailed description of preferred forms and embodiments of the invention throughout which description reference is made to the accompanying drawings.

DETAILED DESCRIPTION OF THE INVENTION

Figure 1:
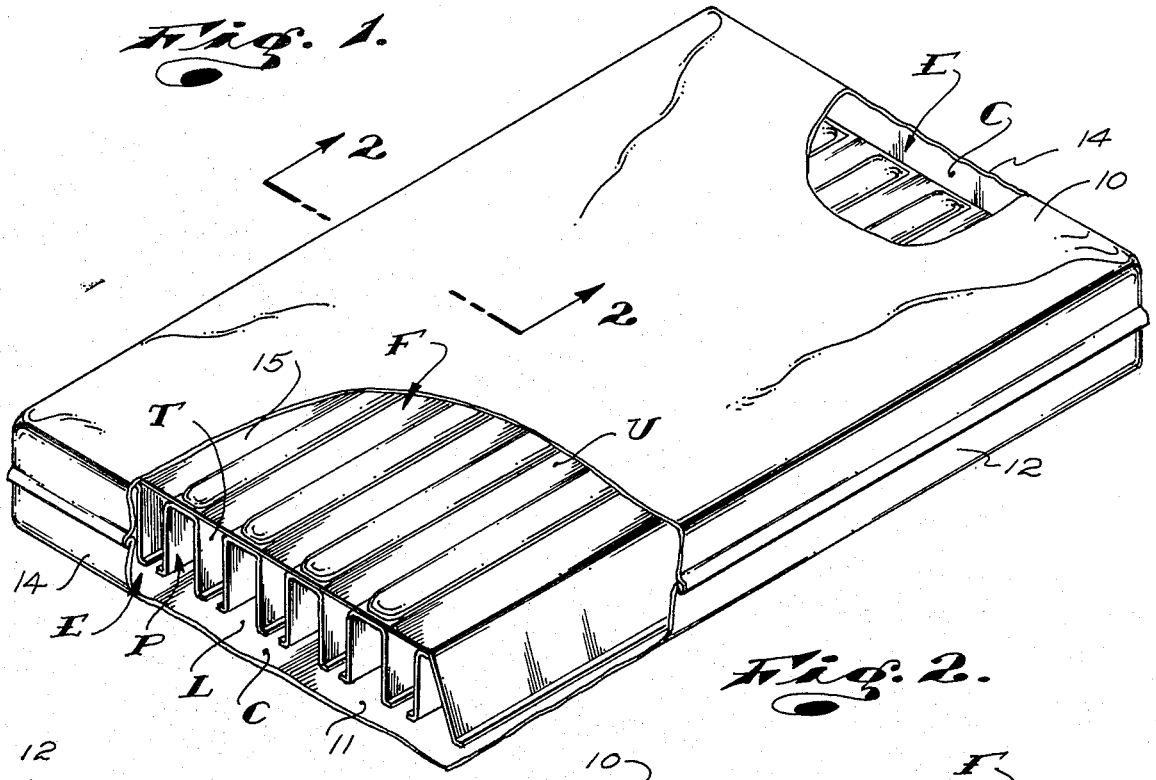
FIG. 1 is an isometric view of a mattress embodying my invention with portions broken away to better illustrate details of the construction.
Figure 2:
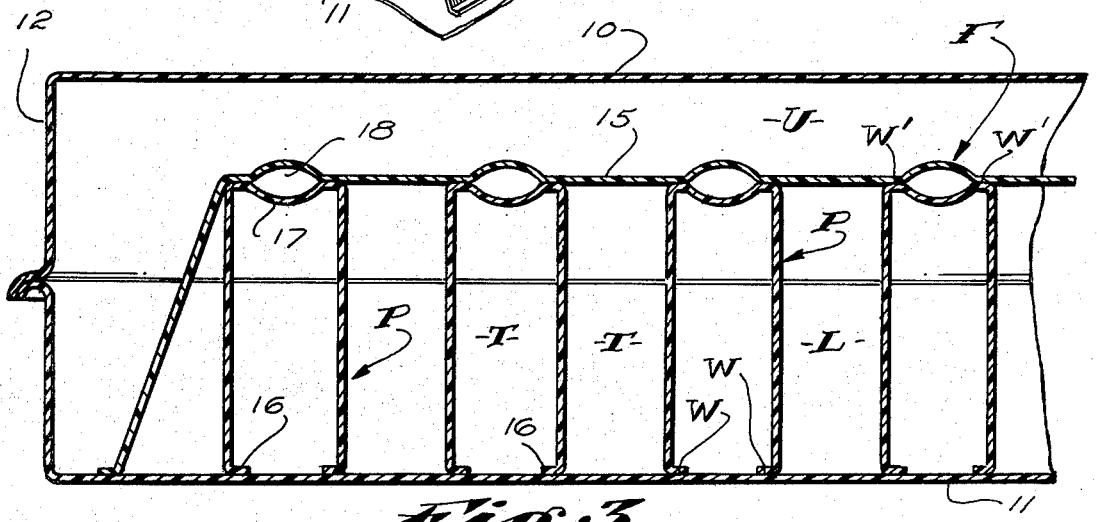
FIG. 2 is a sectional view taken as indicated by line 2—2 on FIG. 1.
Figure 4:
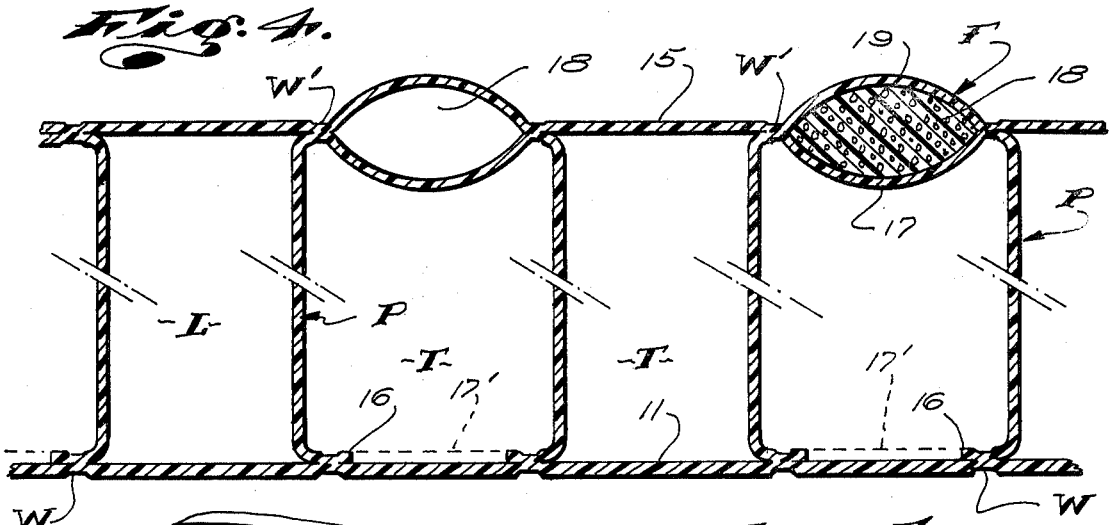
FIG. 4 is an enlarged detailed view of a portion of the structure shown in FIG. 2.

Referring to FIGS. 1, 2 and 4 of the drawings, the present invention includes a basic flotational mattress structure M. The mattress structure M is a flat horizontal unit of thin, flexible and supple plastic sheet material, such as polyvinylchloride. The mattress is rectangular in plan configuration and is characterized by flat, horizontal, vertically spaced top and bottom walls 10 and 11 and flat, vertical side and end walls 12 and 14 about and extending between the perimeters of said top and bottom walls. The several walls 10, 11, 12 and 14 are welded or otherwise integrally joined together to establish a sealed, substantially water-tight bladder like structure.

The basic mattress structure M noted above can, for example, be made or established in accordance with the teaching in U.S. Pat. No. 4,025,975, for "Water Bed Mattress", issued to Raymond M. Phillips and William J. Pease on May 31, 1977.

The details of construction and the manufacturing techniques employed in the establishment of the above noted basic mattress structure can be varied widely without affecting the present invention. Accordingly, this disclosure need not and will not be burdened further with illustration and/or description of the basic mattress structure M.

In furtherance of the present invention, the interior of the basic mattress M shown in the drawings and briefly described is divided vertically by a flat normally horizontal intermediate wall 15 of flexible sheet material similar to the material of which the mattress M is established. The wall 15 divides the interior of the mattress into upper and lower portions or sections U and L. The lower portion L is divided to establish a plurality of elongate longitudinally extending tunnels T. The tunnels T are defined by a plurality of laterally spaced vertical partitions P of thin, flexible plastic sheeting extending between the walls 11 and 15 and arranged in lateral spaced parallel relationship with each other.

In addition to the above, the mattress includes fluid transfer means E to provide for the flow of the fluid medium into, out of and between the tunnels T and flotation means F to normally urge and maintain the intermediate wall 15 and the partitions P in normal up position within the construction and manintain the tunnels T fully open throughout their longitudinal extent.

In the preferred carrying out of the invention, the partitions P, intermediate wall 15 and the tunnels T, defined by said wall and partitions, are coextensive with the central portion of the mattress and terminate in limited predetermined spaced relationship from the end walls 14 of the mattress M to cooperate therewith and define laterally extending chambers C which establish communication with the upper portion U and between the ends of the several tunnels T. The chambers C constitute the whole or a part of the above referred to transfer means E.

The chambers C are preferably limited in cross-sectional extent. For example, the chambers C can be substantially square in cross-section. Accordingly, if the mattress is 8" in vertical extent, the chambers can be from 8"×7" to 8"×9" in cross-section and such that they occupy a negligible and small fraction of the overall area and volumetric extent of the mattress structure.

In the form of the invention now under consideration, the lower edges of the longitudinally extending partitions P have horizontal bottom flanges 16 which occur in flat engagement with the inside surface of the bottom wall 11 of the mattress M and which are integrally joined and/or fixed therewith by welding, as indicated at W.

The upper edges of every other adjacent pair of partitions P are integrally joined by a horizontal web 17 of sheeting which loosely underlies the bottom surface of the inermediate wall 15. The webs 17 are welded to the wall 15 about their perimeters by continuous welds W'. The welds W' extend longitudinally adjacent the partitions and laterally across the ends of the wall 15 to secure the upper edges of the partitions with the intermediate wall 15 and so that the webs and wall 15 cooperate to define laterally spaced, parallel, longitudinally extending pockets 18. The pockets are filled with air or with a cellular, buoyant foam plastic filler or core 19 and establish the aforementioned flotation means F.

In FIG. 4 of the drawings, two pockets 18 are shown, one of them shown filled with air alone while the other is shown filled with a core 19 of foam plastic.

There are several methods and procedures for relating the partitions P in the mattress M. One effective procedure is to arrange lengths of thin-walled, flexible tubular plastic stock on and about a plurality of elongate laterally spaced mandrels which are square or rectangular in cross-section, whereby the tubular stock on the mandrels is formed to define related pairs of laterally spaced vertical partitions P and upper and lower horizontal webs 17 and 17' between said partitions. The mandrels with the tubular stock engaged thereon are arranged between the walls 11 and 15 from one end of the mattress structure (before the top wall 10 of the mattress is in position and before the mattress structure M is otherwise completed and closed). The edge portions of the upper webs 17 are welded (by welds W') to the wall 15 about their perimeters and the side edge portions of the lower webs 17' are welded (by welds W) to the bottom wall 11. Thereafter, the mandrels are withdrawn and the free portions of the lower webs 17' between the welds W and shown in dotted lines in FIG. 4 of the drawings, are cut away adjacent the welds W and are disposed of. Removal of the lower webs 17', as noted above, is desired since if those webs are left in the mattress structure, they tend to establish spaces or pockets in which air becomes entrapped. Such pockets of entrapped air at the bottom wall 11 would likely be undesirable and create adverse effects in the completed structure.

The upper webs are left in place and establish the above described pockets 18 of the flotation means F.

With the construction thus far described, it will be apparent that when the mattress is completed and arranged in supported and contained relationship within a related waterbed frame, and is filled with water or other suitable fluid medium, the flotation means F effectively buoys up and maintains the wall 15 in normal horizontal position below the top wall 10 and maintains the partitions P vertical and the tunnels T fully open.

Subsequently, when a portion of the top wall 10 and thence the intermediate wall 15 of the mattress are depressed as by the weight of a person's body engaged on the top wall 10, the portions of the partitions P and the tunnels T established thereby, at and extending through the depressed portion of the mattress, are collapsed and the water or fluid medium in those tunnels is displaced and caused to flow longitudinally outwardly from the ends of the tunnels T into the chambers C. The fluid medium or water displaced from the tunnels into the chambers C displaces the water or fluid medium in the chambers longitudinally inwardly into other tunnels T which extend through other non-depressed portions of the mattress structure. The friction generated between the water or fluid medium and the walls and partitions defining the tunnels T and the friction loss generated by the changing of the direction of flow between the tunnels T and the chambers C materially slows the movement of the water or medium and thereby slows the rate at which the intermediate wall 15 moves up and/or down. The slowed movement of the water and of the wall 15 buffers any surge and/or residual wave action in the water in and throughout the lower portion L of the mattress structure to a negligible extent.

The slowing of the flow of water or fluid medium and the buffering of surging and residual wave action thereof, afforded by the structure described above, can in certain instances be rather limited and may be less than adequate. To gain additional control of and to further slow the flow of water in the construction and gain further buffering action, the fluid or liquid transfer means E can include supplemental flow limiting means at the ends of the tunnels T to control and slow the flow rate of water into and out of the tunnels T. Such a supplemental or added flow limiting means is shown at V in FIG. 5 of the drawings.

Figure 5:
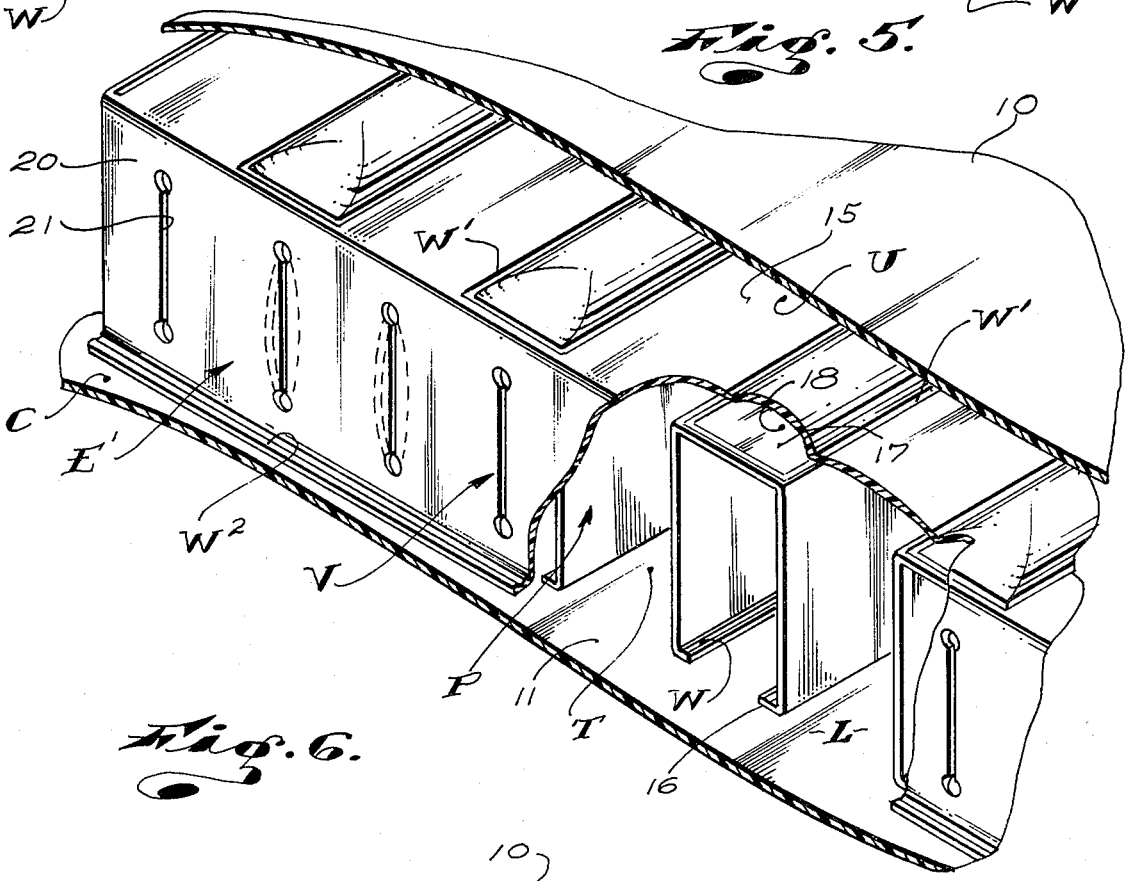
FIG. 5 is an isometric view of a portion of another form of the invention.

The flow limiting means V, shown in FIG. 5 of the drawings, includes vertical end walls 20 established by downwardly turned extensions on the ends of the intermediate wall 15 to overlie and substantially close the open ends of the tunnels T. The lower edges of the walls 20 are fixed to the bottom wall 11 of the mattress structure by welds $W^2$.

The walls 20 are flexible and are provided with slot-like metering openings 21 at the ends of each tunnel $T^1$ and through which the fluid medium or water in the construction can be urged, as circumstances require. It will be noted that due to the flexible nature of the walls 20, the material of those walls about and defining the openings 21 will yield and deform under fluid pressure. Accordingly, the openings 21 will open and increase their flow capacity in proportion to the fluid pressure acting upon the walls 20. The means V act or function as pressure release means and are such that excessive pressures which might otherwise damage the mattress structure cannot be generated by back pressures upstream of the means V during normal and anticipated use of the mattress structure.

In practice, the flow limiting means V can be established by structures other than extensions of the intermediate wall 15, as illustrated and described above. Examples of other or different forms of flow limiting means which can be effectively used in carrying out this invention are disclosed in my copending patent application Ser. No. 059,250, filed July 20, 1979, entitled Surge Dampened Waterbed Mattress.

It will be apparent that in practice, the partitions P of the instant invention can be made serpentine whereby each tunnel T defines a plurality of alternate narrow flow restrictive venturi and enlarged flow circulating chambers, throughout its longitudinal extent, to slow and control the flow of fluid medium or water therein as fully illustrated and described in my above identified copending application, without departing from the spirit of this invention.

It is to be noted that the flotation means F which normally function to buoy up the wall 15 and the partitions P also resist downward displacement of the wall 15 in the fluid medium and therefore functions to further slow the downward movement of the wall 15 and the partitions P, to thereby further dampen or buffer surging of the fluid medium in the construction.

In the foregoing, the partitions P are vertical and the tunnels T established thereby are normally substantially rectangular in cross-section.

Figure 3:
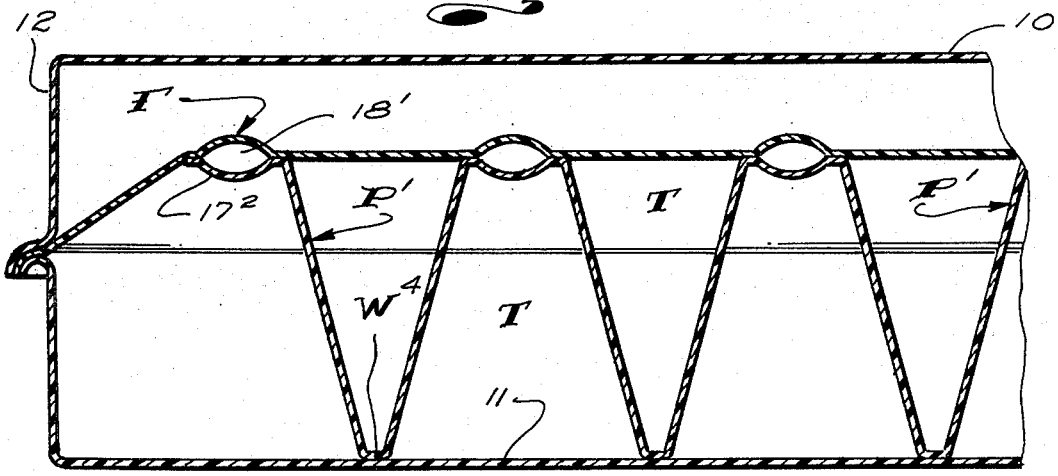
FIG. 3 is a view showing another embodiment of the invention.

In FIG. 3 of the drawings, the partitions P′ are angularly disposed to vertical in a substantial zig-zag manner throughout the lateral extent of the construction whereby the tunnels are alternately upwardly and downwardly convergent substantially V-shaped in cross-section. The upper edges of the tunnels defined by upwardly convergent partitions are truncated by webs 17[2] which, like the webs 17 in the first form of the invention, cooperate with the wall 15′ to establish pockets 18′ of the means F′. In this form of the invention, it will be apparent that the several partitions P′ can be established by a single sheet of flexible plastic stock. The lower edges of adjacent downwardly convergent partitions P′ are fixed to the bottom wall 10′ of the mattress by a single line of weld $W^4$. In all other respects, this form of the invention is or can be essentially the same as the first described form of the invention.

In furtherance of the present invention, the vertical extent of the lower portion L of the construction is such that the vertical extent of the upper portion U and the resulting volume of fluid medium within the upper portions is small. For example, the vertical extent of the upper portion U, between the top and intermediate walls 10 and 15, need only be about 1½″ or 2″ and that the vertical extent of the lower portion L, between the intermediate and bottom walls 15 and 11 can be about 6″ or 6½″. With such a relationship of parts, it will be apparent that the overall vertical extent of the mattress is about 8″ and is therefore sufficient to afford full buoyed up support of the bodies of persons engaged on and supported by the top wall 10 of the construction. Further, with such a relationship, it will be apparent that of the whole or total volume of fluid medium in the construction, about one-quarter of the medium occurs within the upper portion U and is substantially unchecked and free to flow and be displaced by downwardly directed externally applied forces on the top wall 10 and that flow of the remaining three-quarters of the volume of said medium, in the lower portion L, is restricted and/or buffered. Accordingly, when a person moves into supported engagement of the top wall 10, the fluid medium in the upper portion U is rapidly displaced by the force or weight of the person's body and allows the top wall 10 to rapidly move into conforming and supporting engagement with the person's body. Due to the mass of the fluid medium first displaced in the manner described above and the kinetics involved, the movement of the person's body downwardly and into the mattress structure is slowed to a considerable extent.

As the weight of the person's body continues to displace the fluid medium and the portion of the top wall 10 adjacent that body is moved downwardly below the normal horizontal plane of the intermediate wall 15, the wall 15 is engaged and is moved downwardly in advance thereof, collapsing adjacent portions of the partitions P and tunnels T and displacing the fluid medium longitudinally outwardly from those tunnels for distribution throughout the remainder of the mattress structure. Due to the flow restrictive characteristics of the tunnel T and of the means E, the rate at which a person's body moves down into the construction and/or the rate at which the construction yields and is deformed thereby, after the top wall 10 engages the intermediate wall 15 and prior to its establishing buoyant equilibrium in the construction, is slowed materially, but is not adversely impeded. That is, while the lower portion L of the construction operates to slow the rate of movement of the fluid and the resulting rate at which the person's body reaches equilibrium, it does not adversely slow or stop movement of the person's body or prevent the mattress from establishing desired confirmation with that body.

Referring again to the flotation means F, the pockets 18 established by the walls 15 and the underlying webs 17 are filled with air or can be filled with a soft resilient non-interconnected cellular foam plastic filler or core 19 as shown in FIG. 4 of the drawings.

With the form or forms of flotation means noted above, the pockets 18 establish longitudinally upwardly projecting welts in the intermediate wall 15 which might be objectionable.

Figure 6:
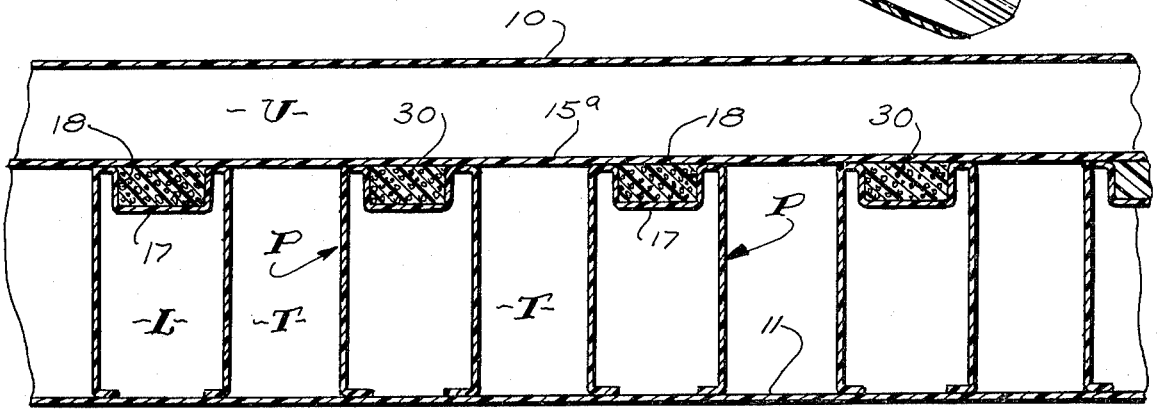
FIG. 6 is a sectional view of still another form of the invention.
Figure 7:
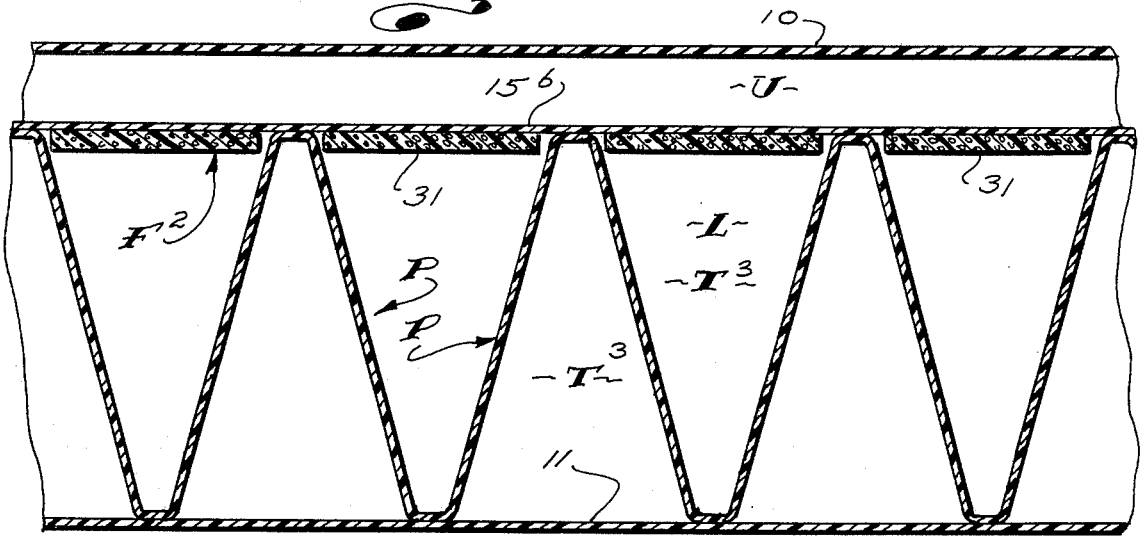
FIG. 7 is a sectional view of another form of the invention.
Figure 8:
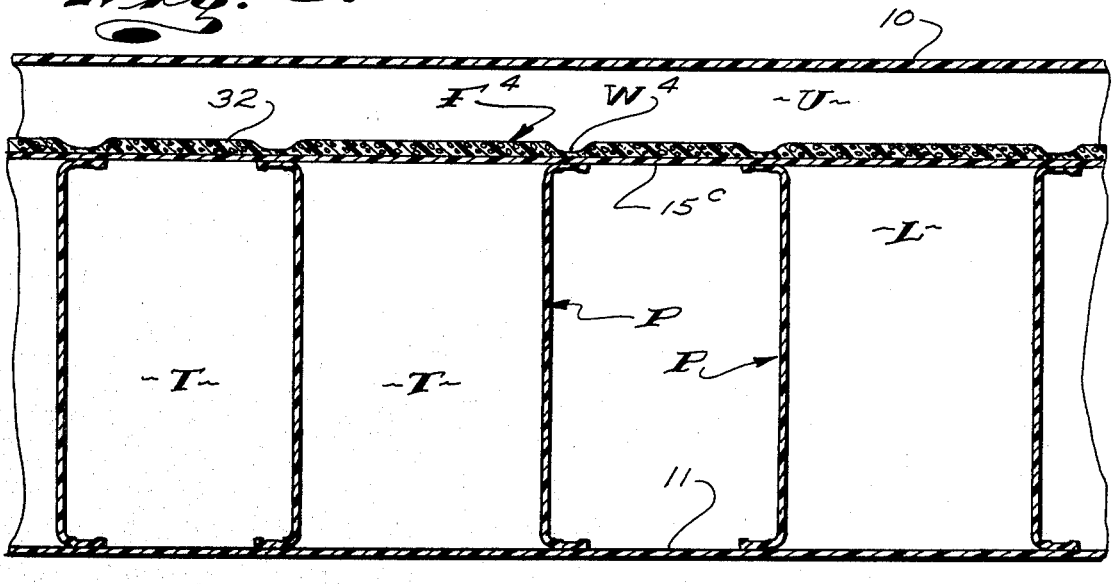
FIG. 8 is a view of yet another form of the invention.

In FIGS. 6 through 8 of the drawings, other forms of flotation means F are illustrated. In FIG. 6 of the drawings, the intermediate wall 15[a] is normally flat, elongate, rectangular strips 30 of non-interconnected cellular foam plastic are engaged in pockets 18, which pockets are established to occur wholly beneath the normally flat plane of the intermediate wall 15[a].

In FIG. 7 of the drawings, the tunnels $T^3$ are V-shaped and arranged so that the base of every other V-shaped tunnel is defined by the wall 15[b]. The flotation means $F^2$ comprises flat, elongate strips 31 of soft resilient non-interconnected cellular foam plastic arranged in each of the tunnels $T^3$, the base of which is defined by the wall 15[b]. The strips 31 arranged adjacent the lower surface of the wall 15[b] can be effectively retained in position in the tunnels by fixing their opposite ends to the wall 15[b] by welding or by means of a suitable solvent or cement. In this form of the invention, the establishing of pockets, similar to the pockets 18 and 18′ in the previously described forms of the invention, is not required.

In FIG. 8 of the drawings, the flotation means $F^4$ comprises a thin sheet 32 of soft resilient non-interconnected cellular foam plastic overlying the wall 15[c] and suitably fixed to the wall 15[c] as by welding $W^4$.

Alternatively, in the last form of the invention, the sheet 32 of foam plastic could be related to the underside of the wall 15[c] or the wall 15[c] could be established of non-interconnected cellular foam plastic sheeting of sufficient strength and durability to withstand the forces and work to which that wall is subjected; without departing from the spirit of this invention.

The above noted different forms of flotation means do not include all forms of flotation means that might be employed in carrying out my invention and are intended to show that the flotation means can take many different forms, within the broader aspects and spirit of the invention.

In practice, the side edge portions of the intermediate wall can be extended and directed downwardly to engage the bottom wall of the mattress M as shown in FIGS. 1 and 2 of the drawings, or can, as shown in FIG. 3 of the drawings, extend laterally to and join or connect with the side walls of the mattress, as desired, or as circumstances require. Further, the ends of the intermediate wall could be extended to join the end walls of the mattress M without departing from the spirit of my inventions. In such a case, it is preferred that the extensions be provided with flow ports to establish communication between the chambers C and the upper portions U of the structure to afford adequate flow of water of fluid medium between the upper and lower portions of the mattresses.

While I have shown and described the tunnels in the construction extending longitudinally, it will be apparent that they could be established to extend laterally, or in any other direction, if desired.

Having described only typical preferred forms and applications of my invention, I do not wish to be limited to the specific details herein set forth, but wish to reserve to myself any modifications and/or variations that may appear to those skilled in the art and which fall within the scope of the following claims:

Having described my invention, I claim:

1. A flotation mattress engageable in a frame having a horizontal platform and vertical side and end rails about and projecting upwardly from the platform; said mattress including an outer bladder of flexible, supple, water impervious sheet material with a flat, horizontal platform engaging bottom wall, vertical rail engaging side and end walls and a flat normally horizontal depressable top wall; a volume of fluid medium within and slackly filling the bladder; a normally flat, horizontal intermediate wall of flexible material in spaced relationship between the top and bottom walls and dividing the interior of the bladder into upper and lower portions; a plurality of spaced, vertical partitions of flexible, supple material fixed with and extending between the bottom and intermediate walls and cooperating therewith to define elongate fluid conducting tunnels with opposite ends in said lower portion of the bladder; flow metering fluid transfer means communicating with and between related ends of the tunnels; flotation means at the intermediate wall normally buoying up and maintaining that wall and the partitions in their normal position within the bladder and wherein said flow metering transfer means includes fluid conducting chambers at and extending between adjacent ends of adjacent tunnels and membranes of flexible material overlying the ends of the tunnels and having flow metering openings communicating with the tunnels and the chambers.

2. The flotation mattress set forth in claim 1 wherein said openings in the membranes are slot openings and the material of the membranes about and defining the openings yieldingly move under applied fluid pressures whereby the flow capacity of the openings increases as fluid pressure acting upon the membranes increases.

3. The flotation mattress set forth in claim 1 wherein said flotation means includes pockets between adjacent pairs of partitions defined by said intermediate wall and webs of flexible and supple material positioned adjacent the intermediate wall and having perimeter edges fixed to said intermediate wall; said pockets being filled with air.

4. The flotation mattress set forth in claim 1 wherein said flotation means includes pockets between adjacent pairs of partitions defined by said intermediate wall and webs of flexible and supple material positioned adjacent the intermediate wall and having perimeter edges fixed to said intermediate wall; said pockets being filled with light buoyant foam plastic.

5. The flotation mattress set forth in claim 1 wherein said flotation means includes strips of flexible buoyant non-interconnected cellular foam plastic in said tunnels adjacent the intermediate wall.

6. The flotation mattress set forth in claim 1 wherein the flotation means includes a thin, flexible sheet of non-interconnected buoyant foam plastic adjacent and fixed to a surface of the intermediate wall.

7. The flotation mattress set forth in claim 1 wherein said intermediate wall is established of a sheet of thin, non-interconnected cellular foam plastic and establishes said flotation means.

8. The flotation mattress set forth in claim 1 wherein said transfer means includes fluid conducting chambers at and extending between adjacent ends of adjacent tunnels.

* * * * *